United States Patent [19]

Jackson

[11] 4,451,711

[45] May 29, 1984

[54] READILY PORTABLE SPEAKER ENCLOSURE

[76] Inventor: Mark Jackson, 144-10 106th Ave., Jamaica, N.Y. 11435

[21] Appl. No.: 261,382

[22] Filed: May 7, 1981

[51] Int. Cl.[3] ..... A47B 87/00

[52] U.S. Cl. ..... 179/146 E; 381/90; 312/7.1; 312/7.2; 312/257 R

[58] Field of Search ..... 179/1 E, 146 E; 312/7.2, 257 A, 108, 257, 265, 264, 263, 7.1

[56] References Cited

U.S. PATENT DOCUMENTS

| | | | |
|---|---|---|---|
| 2,969,268 | 1/1961 | Mason | 312/7.2 |
| 3,064,086 | 11/1962 | Sedley | 179/1 E |
| 3,194,619 | 7/1965 | Dannenberg | 312/7.2 |
| 3,554,623 | 1/1971 | Suckle | 312/7.2 |
| 3,583,780 | 6/1971 | Berkowitz | 312/108 |
| 4,014,597 | 3/1977 | Griffin, Jr. | 179/1 E |
| 4,128,738 | 12/1978 | Gallery | 179/1 E |

FOREIGN PATENT DOCUMENTS

| | | | |
|---|---|---|---|
| 2745719 | 6/1978 | Fed. Rep. of Germany | 179/146 E |

*Primary Examiner*—Harold I. Pitts
*Assistant Examiner*—L. C. Schroeder
*Attorney, Agent, or Firm*—Eric P. Schellin

[57] ABSTRACT

A readily portable speaker enclosure having sides, a back and a top and bottom releasably held together by a clamping assembling wherein reinforcing fastening strips secured to the walls are held together by quick-connect disconnect fasteners, and a speaker board carrying speakers releasably held by the sides, top and bottom, whereby the speaker enclosure may be easily disassembled for storage or transport, thereby facilitating handling of large speakers.

8 Claims, 8 Drawing Figures

READILY PORTABLE SPEAKER ENCLOSURE

BACKGROUND OF THE INVENTION

1. Field of the Invention:

This invention relates generally to speakers, and more particularly, to speaker enclosures. Even more specifically, this invention relates to a speaker enclosure which can be disassembled quickly and easily to facilitate handling and storage of the speaker, and particularly large speakers.

2. Prior Art:

There are many different types of speakers known in the prior art, including speakers having hinged or folded speaker boxes (see U.S. Pat. Nos. 2,036,832 and 4,014,597) and speakers having partitions defining folded folded horns (see U.S. Pat. No. 2,826,260). However, none of these prior art speaker designs teach a speaker enclosure which can be quickly and easily disassembled and assembled.

SUMMARY OF THE INVENTION

Accordingly, it is an object of the invention to provide a speaker having an enclosure which is releasably secured together by a clamping means comprising reinforcing fastening strips and quick-connect disconnect fasteners, so that the speaker may be quickly and easily disassembled and assembled. This greatly facilitates handling and storage of speakers, particularly large speakers, and enables the speaker board, containing the speakers, to be safely stored and handled.

BRIEF DESCRIPTION OF THE DRAWINGS

Referring to the drawings, wherein like reference numerals indicate like parts throughout the several views, the several forms of the invention are illustrated in detail in the figures, wherein.

DETAILED DESCRIPTION OF THE PREFERRED EMBODIMENTS

Figure 1:
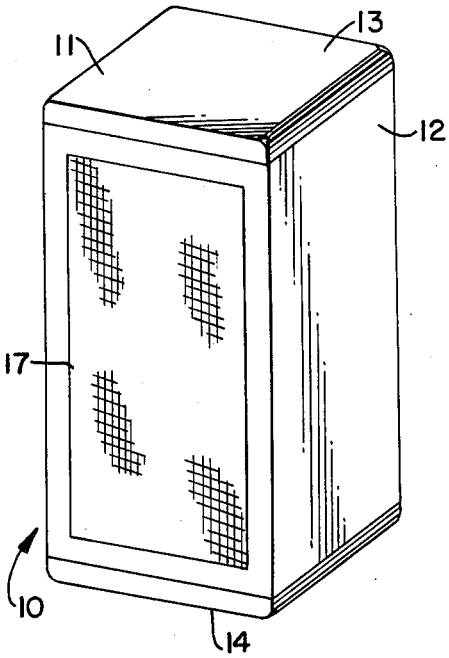
FIG. 1 is a perspective view of a speaker enclosure constructed in accordance with the invention.

A first form of speaker enclosure is indicated generally at 10 and comprises opposite sides 11 and 12, a top 13, bottom 14, back 15, speaker board 16 and grill 17.

The top 13 and bottom 14 are substantially identically constructed, and each includes a panel 18 of wood or other suitable material, either finished naturally or covered with leather or any desired finish, with a pair of reinforcing fastening strips 19 and 20 along opposite sides of the panel, spaced inwardly from the edge thereof and parallel thereto. A second pair of strips 21 and 22 are fastened on top of the first pair of strips, extending transversely thereto parallel to the other edges of the panel. A pair of stud bolts or other suitable fasteners 23 and 24 are secured to the second pair of strips near the opposite ends thereof, and a stud bolt or other suitable fastener 25 is secured to one of the first pair of strips 20 at the midpoint thereof and projects outwardly toward the adjacent edge of the panel.

The opposite sides 11 and 12 are similarly constructed, and each includes a panel 26 with a first pair of strips 27 and 28 along opposite edges of the panel, spaced from the edge and parallel thereto. A second pair of strips 29 and 30 are secured on top of the first pair of strips, extending transversely thereto, and spaced inwardly from the ends of the first pair of strips. The second pair of strips 29 and 30 each have a pair of holes 31 and 32 therethrough, for receiving the stud bolts 23 and 24 carried by the second pair of strips on the top and bottom panels, respectively. Wing nuts or the like 33 are then threaded onto the stud bolts 23 and 24 for fastening the top, bottom and sides together.

The back 15 has a pair of holes 34 and 35 therethrough near the top and bottom edges, and the adjacent outer surface portions are countersunk at 36 and 37. The stud bolts 25 are extended through the holes 34 and 35 and wing nuts or the like 38 are threaded onto the stud bolts to secure the back to the top and bottom.

The walls of the enclosure are held together by a clamping means comprising the reinforcing fastening strips and the quick-connect disconnect fasteners being the bolts and wing nuts. The quick-connect disconnect fasteners hold the strips to one another holding the enclosure together.

The speaker board 16 is held to the top, bottom and sides by the pressure exerted on the edges thereof when the top, bottom and sides are secured together by the stud bolts and wing nuts. As shown, the speaker board carries one or more speakers, such as woofer W, midrange speaker Sm and bass speaker Sb. An electrical lead 39 to the speakers has a quick-disconnect coupling 40 for releasably connecting the speakers to a complemental lead 41 extending through the back 15.

A gasket 42 of foam rubber, felt or other suitable material is disposed between the back 15 and adjacent strips 20 on the top and bottom and strips 28 on the opposite sides of the enclosure, to ensure that the back is tightly secured against the top, bottom and sides.

Figure 2:
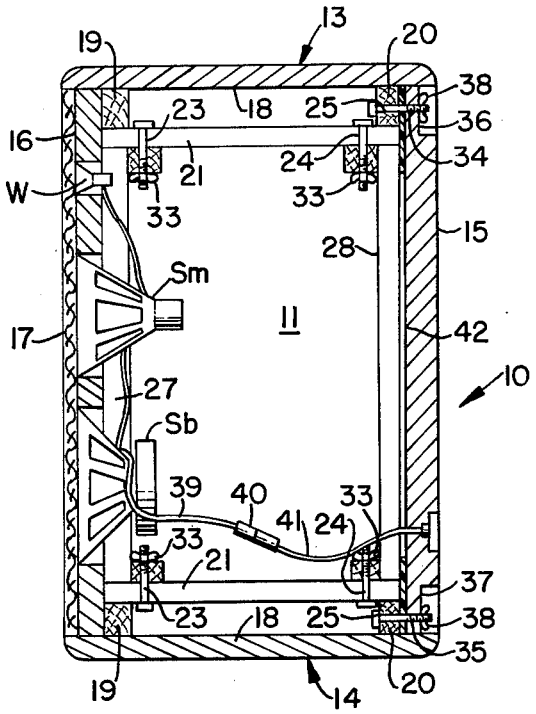
FIG. 2 is a sectional view in side elevation of the speaker enclosure of FIG. 1.
Figure 3:
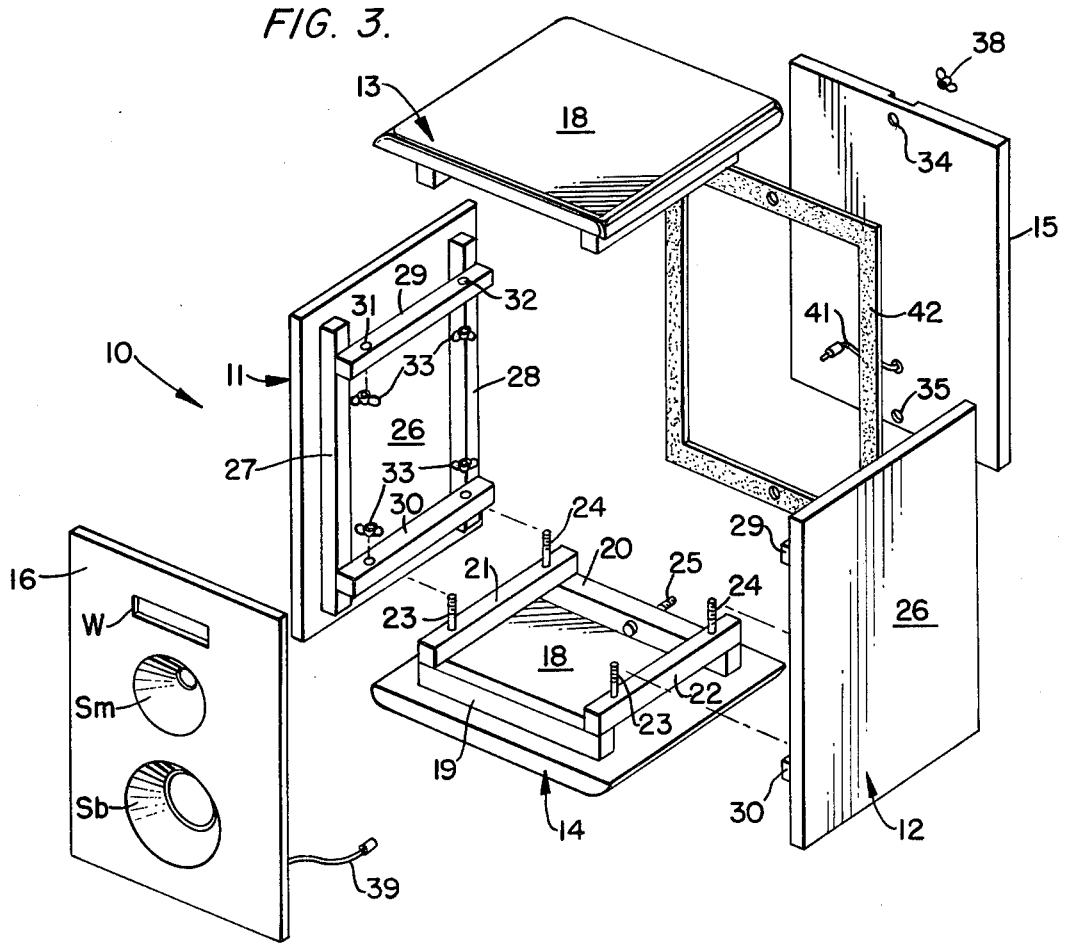
FIG. 3 is an exploded perspective view of the speaker enclosure of FIGS. 1 and 2.

The reinforcing fastening strips are spaced inwardly from the edges of the associated panels a distance such that when the top, bottom, sides and back are assembled together, the edges are flush, as seen in FIGS. 1 and 2.

Figure 6:
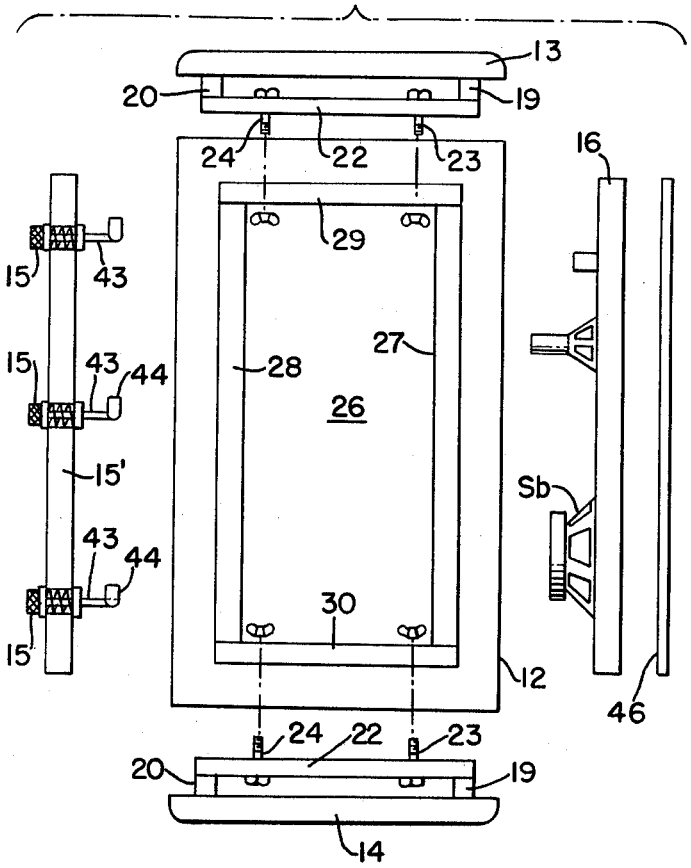
FIG. 6 is an exploded view in elevation of a modification of the speaker enclosure of FIG. 1.
Figure 4:
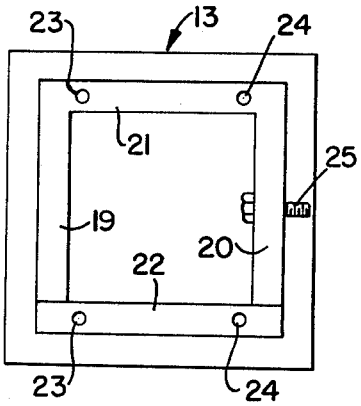
FIG. 4 is a plan view of the bottom wall of the speaker enclosure of FIGS. 1–3.
Figure 5:
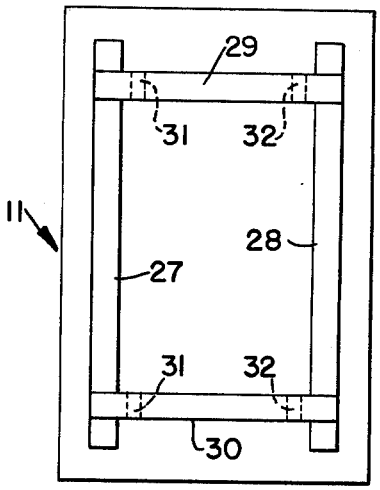
FIG. 5 is a view in elevation of one of the sides of the speaker enclosure of FIGS. 1–3.
Figure 7:
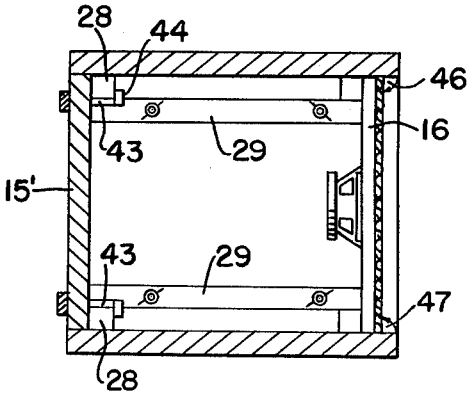
FIG. 7 is a plan view looking down on the speaker enclosure of FIG. 6, with the top wall removed.

A second form of the invention is shown in FIGS. 6 and 7, and is substantially identical to that shown in FIGS. 1–5, except that the back is held on by quarter turn spring latches 43 along opposite edges of the back 15'. The spring latches 43 may be of conventional construction, and include latching projections 44 at the inner ends thereof, and hand operated knurled knobs 45 at the outer ends thereof. Also, quarter round strips 46 and 47 may be provided at the opposite side edges of the speaker grill or board. In other words, the speaker board is held against the strips on the top, bottom and side panels by the quarter round strips, in addition to the clamping pressure provided by the tightened down sides, top and bottom.

Figure 8:
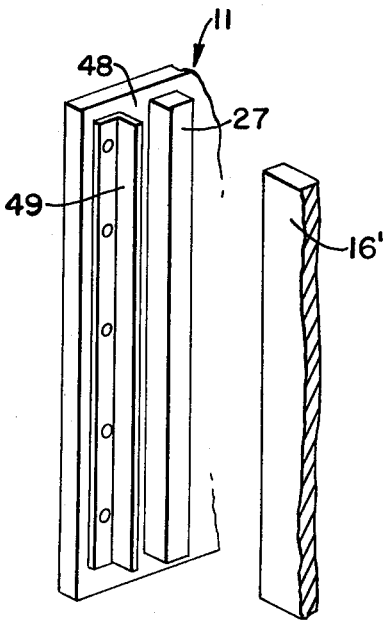
FIG. 8 is a fragmentary perspective view of a second modification of the speaker enclosure of FIG. 1.

A third form of the invention is shown in FIG. 8, and is substantially identical to the forms previously described, except that the speaker board 16' may be slipped into a channel 48 formed between the strips 27 and an angle member 49 fastened to the sides in spaced, parallel relationship to the strips 27.

The panels, strips and speaker board may be made of wood or other suitable materials, and other quick-connect disconnect fasteners than the stud bolts and wing nuts may be used.

I claim:

1. A readily portable speaker enclosure, comprising:

a plurality of walls having inner and outer surfaces and including a top, a bottom, opposite sides and a back;

a speaker board carrying at least one speaker;

clamping means on the top, bottom, opposite sides and back to readily releasably secure the top, bottom, opposite sides and back together, the clamping means includes reinforcing fastening strips disposed on the inner surfaces of the top, bottom and opposite sides, adjacent the edges thereof, when the walls are assembled together, and quick-connect disconnect fastening means for fastening the reinforcing fastening strips to one another; and means on the top, bottom and opposite sides to securely hold the speaker board in position to form part of the enclosure when the top, bottom and opposite sides are separated.

2. A readily portable speaker enclosure, as defined by claim 1, wherein the quick-connect disconnect fastening means comprises bolts on some of the reinforcing fastening strips and cooperating holes in the other strips, and wing nuts for cooperating with the bolts thereby forming the clamping means.

3. A readily portable speaker enclosure, as defined by claim 2, wherein the quick-connect disconnect fastening means further comprises at least one releasable fastener holding the back in position to the rest of the speaker enclosure and which can be readily connected and disconnected so that the back may be releasably secured to the rest of the speaker enclosure.

4. A readily portable speaker enclosure, as defined by claim 3, wherein the at least one releasable fastener comprises a bolt which cooperates with a wing nut on the outer surface of the back to hold the back in position.

5. A readily portable speaker enclosure, as defined by claim 3, wherein the at least one releasable fastener comprises a quarter turn spring latch having a knob on the outer surface of the back, and which releasably fastens the back to the rest of the speaker enclosure.

6. A readily portable speaker enclosure, as defined by claim 5, wherein the speaker board is clamped at its edges between the top, bottom and opposite sides.

7. A readily portable speaker enclosure, as defined by claim 5, wherein an angle member is fastened to the sides in closely spaced relationship to the reinforcing fastening strips thereby forming a channel on each side wall; and the opposite edges of the speaker board are received in the channels.

8. A readily portable speaker enclosure, as defined by claim 7, wherein a quick disconnect electrical coupling is connected to the speaker; and a complementary disconnect electrical coupling is connected with the back, for releasably connecting the speaker from a source of energy.

* * * * *